United States Patent [19]

Zimmer

[11] 4,023,488

[45] May 17, 1977

[54] FLAT STENCIL FOR IMPRINTING TEXTILE FABRICS

[76] Inventor: Peter Zimmer, Untere Sparchen 54, Kufstein, Austria, A 6330

[22] Filed: Oct. 22, 1975

[21] Appl. No.: 624,935

[30] Foreign Application Priority Data

Oct. 22, 1974 Austria ..... 8481/74

[52] U.S. Cl. ..... 101/127.1; 38/102

[51] Int. Cl.[2] ..... B41F 15/36

[58] Field of Search ..... 101/114, 127.1, 128.1; 38/102, 102.3, 102.91; 118/504

[56] References Cited

UNITED STATES PATENTS

| | | | |
|---|---|---|---|
| 877,972 | 2/1908 | Weber, Jr. | 101/127.1 X |
| 3,211,089 | 10/1965 | Messerschmitt | 101/127.1 |
| 3,303,777 | 2/1967 | Feier et al. | 101/127.1 |
| 3,356,023 | 12/1967 | Schuttenberg | 101/127.1 X |
| 3,391,635 | 7/1968 | Matheus | 101/127.1 |
| 3,769,908 | 11/1973 | Griffin | 101/127 |
| 3,779,539 | 12/1973 | Ziers | 38/102.91 X |

FOREIGN PATENTS OR APPLICATIONS

| | | | |
|---|---|---|---|
| 2,250,093 | 4/1974 | Germany | 101/127.1 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

An apertured rectangular foil of substantially inextensible sheet metal, e.g. nickel or steel, has a hole at each corner engaged by a resiliently biased gripper exerting on it a diagonally outward force to hold the foil stretched in a surrounding tenter frame supporting these grippers. The frame is provided with marginal ledges, underlying the foil at least along the major sides of the rectangle, onto which the foil edges are releasably pressed by toggle clamps.

9 Claims, 6 Drawing Figures

FLAT STENCIL FOR IMPRINTING TEXTILE FABRICS

FIELD OF THE INVENTION

My present invention relates to a flat stencil for the imprinting of textile fabrics or the like.

BACKGROUND OF THE INVENTION

Such stencils, to which printing dye can be applied with the aid of a squeegee or a roller, are conventionally designed as silk screens surrounded by rectangular frames to which they are attached on all sides. These horizontal frames, generally of steel, usually are about 5 cm high and therefore take up considerable space in stacking. The connection between the screen and the frame must be permanent since otherwise shifts may occur in the pattern which are particularly troublesome if that pattern is for one color component of a multicolor composite design.

Attempts have already been made to replace these silk screens by apertured sheet-metal foils, e.g. of nickel or steel, with a thickness of several tenths of a millimeter. Such foils are dimensionally stable and can therefore be interchangeably clamped in a mounting frame; their stacking requires only a fraction of the space needed for a corresponding number of silk screens. A drawback of these printing foils, however, resides in their lack of elasticity whereby even minor irregularities in the clamping pressure give rise to creases which mar the pattern and prevent the use of the stencil for printing.

OBJECT OF THE INVENTION

The object of my present invention, therefore, is to provide an improved stencil of the character described which employs a thin sheet-metal foil, generally less than a millimeter thick, removably held in a mounting which avoids the risk of creasing or other pattern deformation, thus fully preserving the advantages of easy handling and low stacking height inherent in the use of such foils.

SUMMARY OF THE INVENTION

In accordance with the present invention, I provide a rigid rectangular tenter frame with stretching means at its corners releasably engaging the apertured sheet-metal foil under outward tension, preferably with stress components parallel to both major dimensions of the rectangle. Pursuant to a more particular feature of my invention, the stretching means comprise a set of four holders — one on each corner — supporting gripping elements which are urged outwardly, in substantially diagonal directions, by associated reversible tensioning means such as spindles or screws. I have found that, for the avoidance of unsymmetrical stress distribution, one or two of the gripping elements should be positively guided in their holders for such substantially diagonal movement only whereas at least two others, preferably sharing a common side of the rectangle, should be articulated for swinging in the plane of the foil. Once the foil is properly tentered by these grippers, it may be clamped along at least two opposite edges — preferably at the major sides of the rectangle — to the frame, specifically to ledges underlying marginal foil portions, without a risk of pattern deformation. The positively guided gripper or grippers provide the necessary stability and reproducibility of the working position.

BRIEF DESCRIPTION OF THE DRAWING

The above and other features of my invention will now be described in detail with reference to the accompanying drawing in which.

SPECIFIC DESCRIPTION

Figure 2:
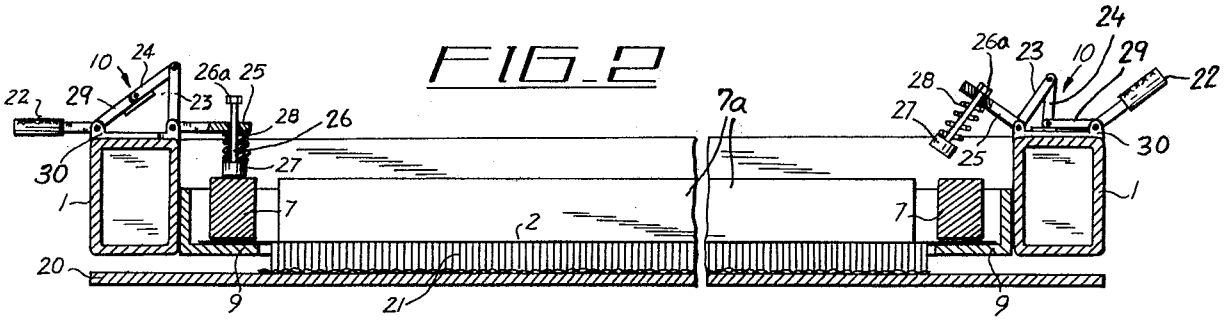
FIG. 2 is a cross-sectional view of the stencil taken on the line II — II of FIG. 1 and drawn to a larger scale.

In the drawing I have shown a rigid rectangular tenter frame 1, e.g. of steel, formed from tubular stock. A stencil sheet 2 in the shape of a thin metallic foil, e.g. of nickel, has pattern-forming apertures 2*a* through which printing ink may be deposited on an underlying substrate 21 such as a pile fabric resting on the top 20 of a printing table not further illustrated (FIG. 2). The frame 1 may be fixedly secured to the table by brackets or the like, not shown.

Figure 1:
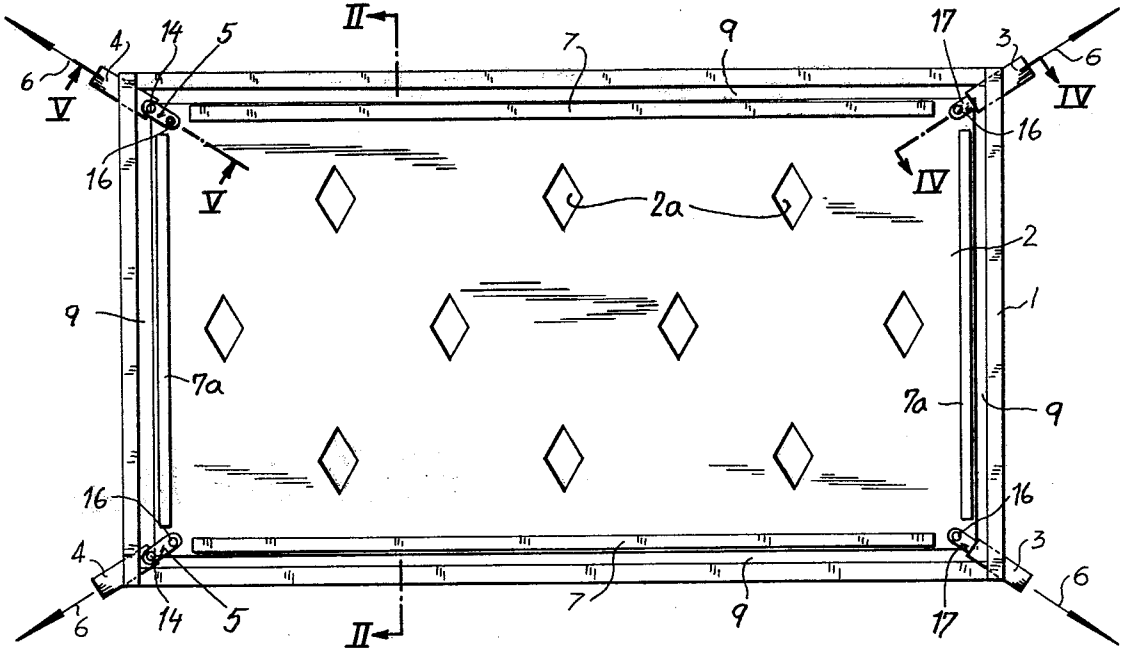
FIG. 1 is a top plan view of a flat stencil embodying my invention.

At each corner of the frame 1 I provide a stretching device exerting diagonally outward tension on the foil 2, as indicated by arrows 6, i.e. two devices 3 with a single degree of freedom at right in FIG. 1 and two devices 4 with two degrees of freedom at left. Each of these devices, whose construction will be described in detail hereinafter with reference to FIGS. 4 and 5, comprises a gripper element 17 or 5 carrying at its free end a stud 16 which passes from below through a hole 8 in the foil whereby the latter can be readily engaged with and disengaged from these elements. Gripper elements 5 of devices 4 are swingable horizontally, i.e. in the plane of the foil, about respective fulcra 14.

Figure 3:
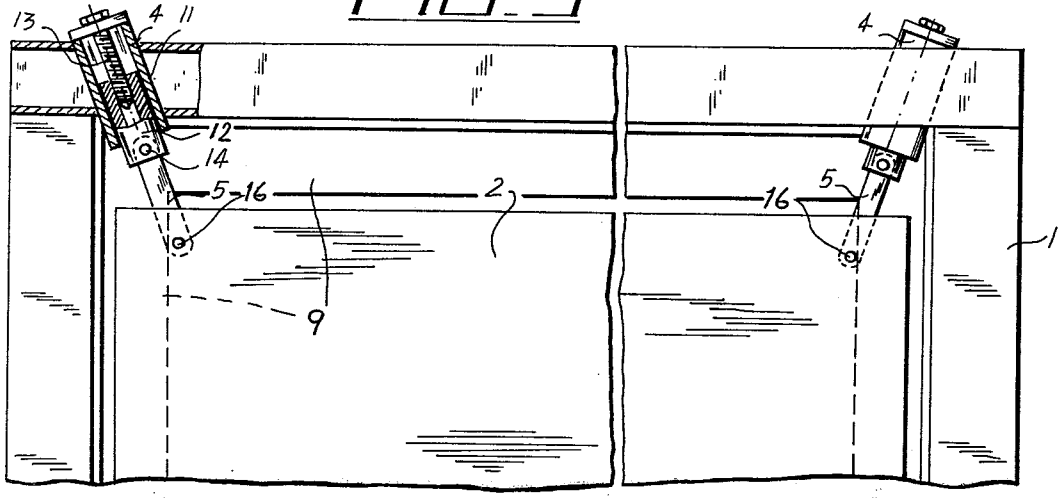
FIG. 3 is a fragmentary top view of the stencil, drawn to the scale of FIG. 2 and partly in section.

Rigid with frame 1 are a set of angle irons forming ledges 9 to support marginal portions of foil 2, these ledges being shown in FIGS. 1 – 3 to extend along both the major and the minor sides of the rectangular frame and foil. Bars 7 and 7*a* are loosely deposited on these marginal foil portions, above the ledges 9, after the foil has been tensioned by the devices 3 and 4; the foil is then locked in position with the aid of toggle clamps 10 that are mounted on the frame 1 and press the bars 7, 7*a* against the ledges 9 with the foil sandwiched therebetween. As seen in FIG. 2, where a clamp 10 has been shown closed on the left while another is shown open on the right, each of these clamps comprises a base 30 rigid with its supporting frame member, an elbow 29 pivoted to that base and provided with a handle 22, a link 24 articulated to the opposite end of that elbow, and a bell-crank lever with an arm 23 articulated to link 24 and an arm 25 traversed by a plunger 26 which terminates in a head 27. The plunger 26, under pressure from a coil spring 28, is secured against dislodgment by a nut 26*a* threaded onto its stem.

Figure 5:
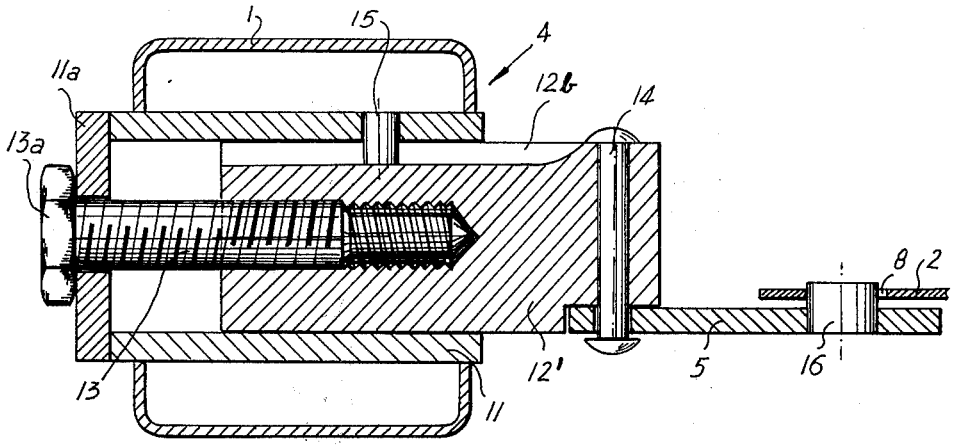
FIGS. 4 and 5 are sectional detail views taken, respectively, on lines IV — IV and V — V of FIG. 1 and drawn to a still larger scale.
Figure 4:
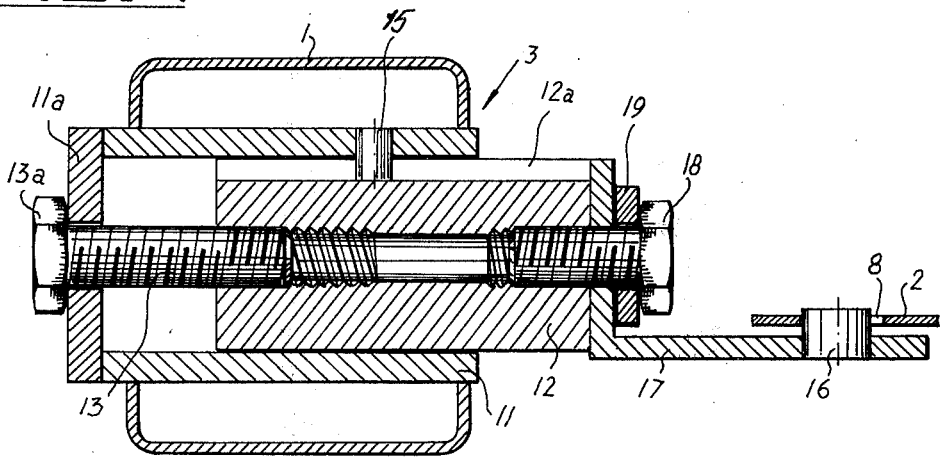

The two stretching devices 3 and 4, as shown in FIGS. 4 and 5, are of generally similar construction and comprise each a sleeve 11 lodged in a diagonal bore of frame 1 and held in place by soldering or other fastening means. The outer end of sleeve 11 is closed by a lid 11*a* traversed by a screw 13 with an outwardly projecting head 13*a*, the screw 13 threadedly engaging a slider 12 (FIG. 4) or 12′ (FIG. 5) provided with a longitudinal groove 12*a* or 12*b*, respectively, in which engages a pin 15 rigid with the sleeve so as to hold the slider against rotation. Gripper 17 is an angle element with a short leg secured to the sleeve 12 by a screw 18 bearing upon a washer 19 and with a long leg carrying the stud 16 which passes from below through the corresponding hole 8 of foil 2. Gripper 5 is a flat strip pivotally connected with sleeve 12′ by a rivet 14 constituting its aforementioned fulcrum. Sleeve 11 serves as a holder for the slider 12 or 12′ which is positively guided therein along the corresponding frame diagonal.

Figure 6:
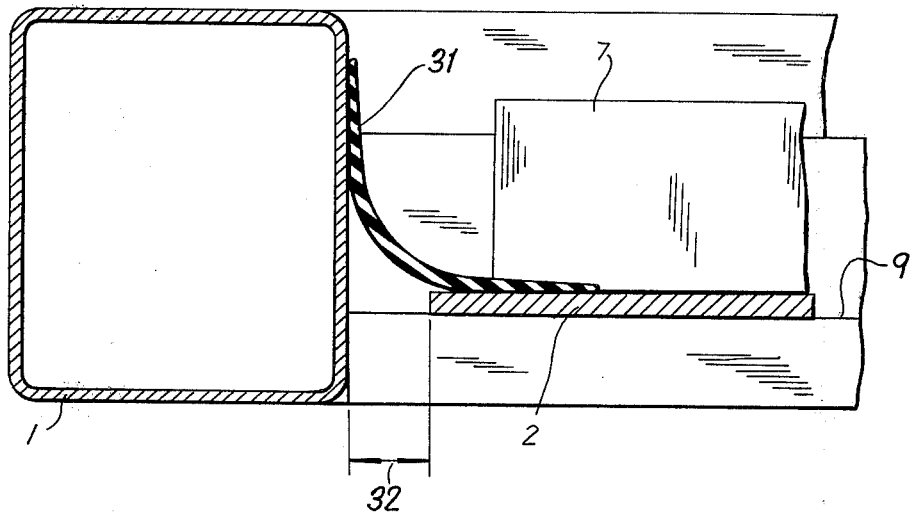
FIG. 6 is a fragmentary cross-sectional view of the stencil drawn to the scale of FIGS. 4 and 5, showing a modification.

The presence of ledges 9 on all sides of the frame prevents any leakage of printing fluid from the upper surface of foil 2 around its edges to the underlying substrate 21. If only two such ledges and clamping bars are provided, e.g. with the shorter bars 7*a* omitted as shown in FIG. 6, an apron 31 of rubber or the like secured to the tenter frame 1 along each of its minor edges and extending onto the foil 2 can bridge the gap 32 between the foil and the frame to avoid such leakage.

It will be evident that, with the construction shown and described, a foil 2 can be readily removed from its tenter frame 1 and replaced by another, for the printing of a different color component on the same substrate 21, without any relative movement between the frame and the substrate whereby multicolor designs can be produced with sharp boundaries between the colors. Such removal requires only the opening of the toggle clamps 10, the lifting of the bars 7 and 7*a* (if provided) and the loosening of the screws 13 of devices 4, the corresponding screws of devices 3 being left untouched. The reverse procedure, of course, is followed in the operative emplacement of a foil.

I claim:

1. A flat stencil for imprinting textile fabrics, comprising:

a rigid rectangular tenter frame;

a substantially rectangular sheet-metal foil with pattern-forming apertures surrounded by said tenter frame; and a set of four stretching devices positioned at respective corners of said tenter frame;

at least one of said stretching devices being of a first type provided with a first holder, a first slider positively guided in said first holder for displacement along a diagonal of the rectangle, a first gripping element rigid with said first slider releasably engaging a corner of said foil, and first tensioning means anchored to said first holder and to said first slider for reversibly displacing said first gripping element;

the remaining stretching devices being each of a second type provided with a second holder, a second slider positively guided in said second holder for displacement along a diagonal of the rectangle, a second gripping element releasably engaging a corner of said foil, said second gripping element being pivoted to said second slider for swinging in the plane of said foil, and second tensioning means anchored to said second holder and to said second slider for reversibly displacing said second gripping element.

2. A stencil as defined in claim 1 wherein said foil and said tenter frame are horizontal, said foil being provided with holes at the corners thereof, said gripping elements being provided with studs passing from below through said holes.

3. A stencil as defined in claim 1 wherein said tenter frame is horizontal and is provided with ledges underlying marginal portions of said foil along at least the major sides of the rectangle, further comprising clamping means on said frame releasably pressing said marginal portions against said ledges.

4. A stencil as defined in claim 3 wherein said clamping means comprises a bar overlying each of said marginal portions and at least one toggle clamp engageable with said bar.

5. A stencil as defined in claim 3 wherein said ledges extend along all four sides of the rectangle.

6. A stencil as defined in claim 3, further comprising flexible aprons extending from said tenter frame to the upper surface of said foil along the minor sides of the rectangle.

7. A stencil as defined in claim 1 wherein said foil is less than a millimeter thick.

8. A stencil as defined in claim 1 wherein two of said stretching devices on one side of said frame are of said first type and the remaining two stretching devices on the opposite side of said frame are of said second type.

9. A flat stencil for imprinting textile fabrics, comprising:

a rigid horizontal tenter frame of rectangular shape;

a substantially rectangular sheet-metal foil with pattern-forming apertures, said tenter frame surrounding said foil and forming ledges which underlie marginal portions of said foil along the major sides of the rectangle;

stretching means at the corners of said tenter frame releasably engaging said foil for imparting tension thereto;

clamping means on said tenter frame releasably pressing said marginal portions against said ledges; and flexible aprons extending from said tenter frame to the upper surface of said foil along the minor sides of the rectangle.

* * * * *